US008978270B1

(12) United States Patent
Carlton et al.

(10) Patent No.: US 8,978,270 B1
(45) Date of Patent: Mar. 17, 2015

(54) METHOD FOR DRYING INTERSTITIAL SPACE

(71) Applicant: Advanced Moisture Solutions, LLC, Southlake, TX (US)

(72) Inventors: Wesley Clyde Carlton, Southlake, TX (US); David Laurence Green, Grand Prairie, TX (US)

(73) Assignee: Advanced Moisture Solutions, LLC, Southlake, TX (US)

( * ) Notice: Subject to any disclaimer, the term of this patent is extended or adjusted under 35 U.S.C. 154(b) by 0 days.

(21) Appl. No.: 14/444,605

(22) Filed: Jul. 28, 2014

(51) Int. Cl.

| | |
|---|---|
| ***F26B 19/00*** | (2006.01) |
| ***E04B 1/70*** | (2006.01) |
| ***F26B 3/06*** | (2006.01) |
| ***F26B 21/14*** | (2006.01) |
| ***F26B 21/08*** | (2006.01) |
| ***F26B 21/12*** | (2006.01) |
| *F25D 19/00* | (2006.01) |

(52) U.S. Cl.
CPC . *F26B 3/06* (2013.01); *F26B 21/14* (2013.01); *F26B 21/08* (2013.01); *F26B 21/12* (2013.01)
USPC ..... 34/487; 165/287; 454/350; 62/454

(58) Field of Classification Search
CPC ..... F26B 3/00; F26B 5/00; F26B 19/00; F26B 21/06; F25D 19/00; F25D 19/006; F28F 27/00; E04B 1/70
USPC ..... 34/427, 443, 487, 497, 545; 166/267, 166/302; 165/165, 200, 287; 62/51.1, 424; 454/350
See application file for complete search history.

(56) References Cited

U.S. PATENT DOCUMENTS

| | | | | |
|---|---|---|---|---|
| 1,731,050 | A * | 10/1929 | Judelson | 211/103 |
| 3,805,405 | A * | 4/1974 | Ambos | 34/104 |
| 5,408,759 | A * | 4/1995 | Bass | 34/104 |
| 5,651,193 | A * | 7/1997 | Rhodes et al. | 34/531 |
| 5,893,216 | A * | 4/1999 | Smith et al. | 34/103 |
| 6,647,639 | B1 | 11/2003 | Storrer | |
| 6,691,427 | B1 * | 2/2004 | Fernandes et al. | 34/60 |
| 6,754,976 | B1 * | 6/2004 | Edwards | 34/140 |
| 6,886,271 | B2 | 5/2005 | Storrer | |
| 7,047,664 | B1 * | 5/2006 | Martinez | 34/380 |
| 7,383,643 | B2 * | 6/2008 | Blankenship et al. | 34/406 |
| 7,568,297 | B2 * | 8/2009 | Pierson et al. | 34/218 |
| 8,006,407 | B2 * | 8/2011 | Anderson | 34/381 |
| 8,056,252 | B2 * | 11/2011 | Fernandes | 34/60 |
| 8,468,716 | B1 * | 6/2013 | Walker et al. | 34/435 |
| 8,713,874 | B2 * | 5/2014 | Bingham | 52/302.3 |
| 8,850,713 | B2 * | 10/2014 | Nakamura et al. | 34/90 |
| 8,904,664 | B2 * | 12/2014 | Pringle et al. | 34/105 |
| 2008/0250594 | A1 * | 10/2008 | Green | 15/210.1 |
| 2009/0094932 | A1 * | 4/2009 | Pedersen | 52/716.2 |

FOREIGN PATENT DOCUMENTS

WO WO 2005094538 A3 * 10/2006

* cited by examiner

*Primary Examiner* — Steve M Gravini
(74) *Attorney, Agent, or Firm* — Buskop Law Group, PC; Wendy Buskop

(57) ABSTRACT

A method for drying or removing water from a wall cavity or structure without the need to tear to make holes, tear apart the structure, or use suction cups. The method uses a reversible portable moisture removal system for flowing pressurized heated air at a targeted location and for creating a vacuum to withdraw moist air from the wall cavity or structure a the moisture removal housing. The method dries wet walls in less time than current systems while also being reversible to remove moist air from wall cavities and structures.

17 Claims, 5 Drawing Sheets

METHOD FOR DRYING INTERSTITIAL SPACE

FIELD

The present embodiments generally relate to a method for drying a wall cavity or structure without the need to tear open to make holes, tear apart the structure, or use suction cups.

BACKGROUND

A need exists for a method to rapidly dehumidify a building without damaging, modifying or destroying a building structure or any of its parts. This method will drastically reduce both the cost and the time needed to restore a building after water damage.

A further need exists for reducing the impact on business interruption during the drying process.

The present embodiments meet these needs.

BRIEF DESCRIPTION OF THE DRAWINGS

The detailed description will be better understood in conjunction with the accompanying drawings as follows.

Figure 1:
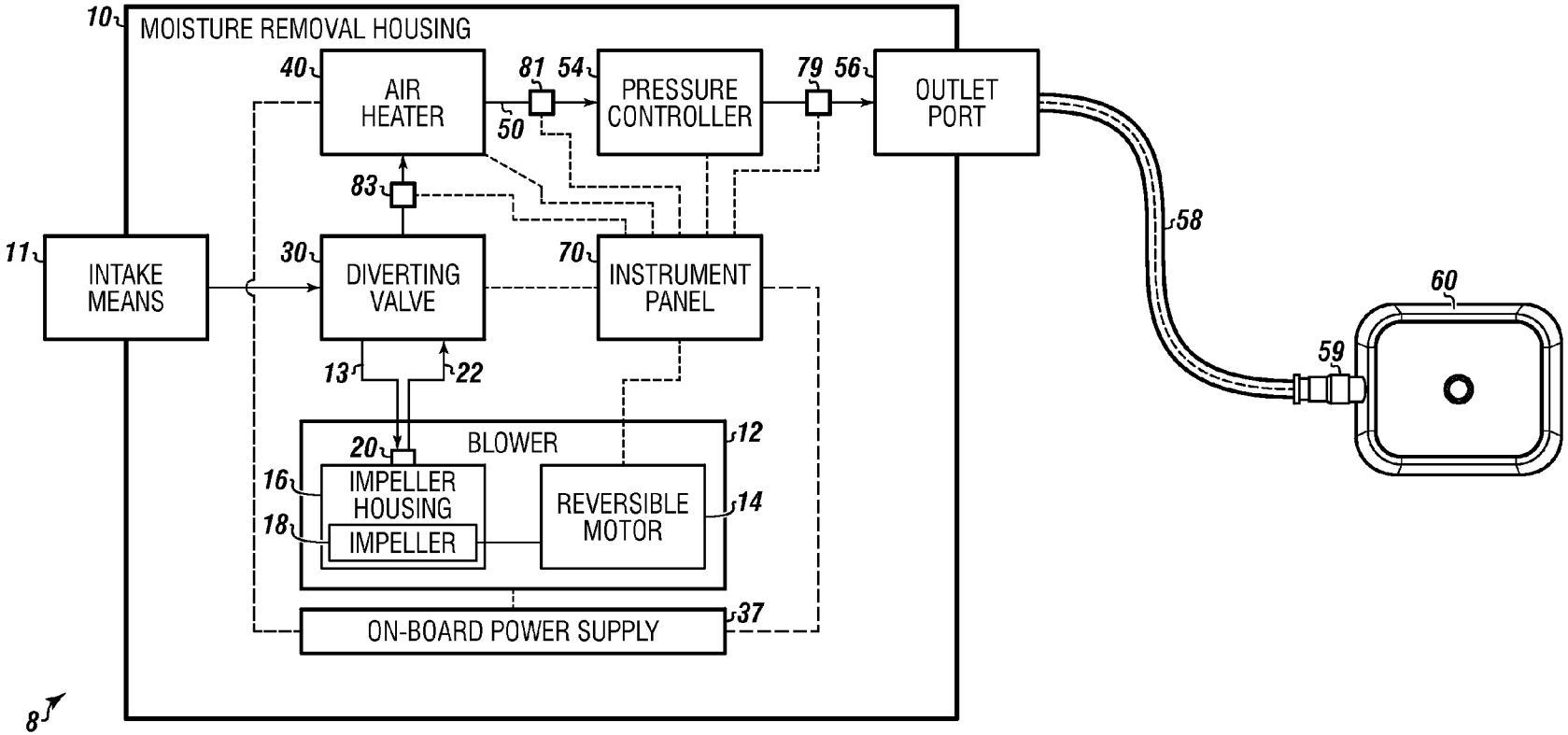
FIG. 1 is a diagram of an overview of the system.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The method enables fast drying of walls without the need to tear open, make holes, or tear drywall.

The method is usable without removing sheet rock enabling a business to continue to operate while the walls are being dried. No dust, no cutting, no mess is achieved while drying with minimal noise.

The remote control feature of this invention allows an operator to stand a safe distance away from a structure needing to be dried, such as a structure in a nuclear facility with radiation that might harm the operator. Similarly, if drying of mold is needed in order to safely remove construction or building materials, the operator can dry the mold a safe distance away without breathing the toxic, noxious material that could be harmful to the operator.

The method can be quickly deployed in the event of a hurricane, a tornado, a terrorist event, fire, or any other disaster that includes the release or impact of water.

Typically with conventional methods, it can take from 5 to 10 days to dry a wall with existing methodologies and ordinary equipment and blowers. The present method can dry an entire wall in 1.5 days.

In embodiments, the operator wheels the reversible portable moisture removal system to within 1 to 15 feet of a wall or structure to be dried. The unit is light enough that a single person can easily move the unit.

To dry the wall or structure, an operator first removes either (i) a light switch cover mounted to a wall, or (ii) a power outlet cover mounted to a wall.

The operator takes a docking station usable with the method and using a long screw, attaches the docking station into at least one of the screw holes that hold the light switch cover or the power outlet cover to the light switch box in the wall or the power outlet box in the wall.

The operator then verifies that a diverting valve on a moisture control housing usable with the docking station is either in (i) a vacuum operating condition or (ii) a pressure operating condition. The operator then places the diverting valve into the operating condition desired depending on which type of air motion the operator desires to impact the wall or structure.

The operator then sets a pressure for the pressurized heated air to ensure the pressurized heated air is maintained within preset limits.

The operator uses either (i) the instrument panel mounted to the moisture control housing; (ii) a pendant control station hardwired to but geographically apart from the instrument panel; or (iii) a wireless remote control device remote from the system but in communication with the instrument panel to switch on the reversible portable moisture removal system.

The operator then sets an air temperature desired for the pressurized heated air using an air temperature gauge on the instrument panel.

The operator then monitors the air temperature gauge to ensure the air temperature is within the operator set preset limits.

The operator then monitors the pressure gauge to ensure the pressure of the pressurized heated air is within the operator preset limits.

The operator also monitors the air flow indicator using signals from a flow meter positioned to monitor the flow rates of the pressurized heated air to ensure the air is flowing into the docking station within defined flow rates.

The operator can monitor a run meter to ensure routine maintenance is performed.

The method can be better understood with reference to the Figures describing the equipment usable to implement the method.

Turning now to the Figures, FIG. 1 is a diagram of an overview of the system.

The reversible portable moisture removal system 8 for drying a structure or wall cavity without creating holes in the wall or structure has a moisture removal housing 10.

The moisture removal housing 10 can be made from durable plastic or formed metal, such as steel or aluminum.

In embodiments, the moisture removal housing can have a size from 40 inches to 60 inches in height and 18 inches to 30 inches in width. Additional sizes can be used depending upon the job size and structure.

In embodiments, the moisture removal housing with all the electronics can weigh from 70 pounds to 150 pounds.

In the system, an intake means 11 can receive atmospheric air 13 into the moisture removal housing 10.

In embodiments, the intake means can be an air intake, a valve, or a closable port. The intake means can have a diameter from 1 inch to 3 inches.

In embodiments, the intake means 11 can be an air filter, a silencer, or both an air filter and a silencer.

A blower 12 can be installed in the moisture removal housing 10 for receiving the atmospheric air 13 from the intake means 11.

In a different configuration, the atmospheric air can flow first to a diverting valve 30, then to the blower 12 and then a pressurized air stream 22 from the blower 12 can flow back to the diverting valve 30.

In still another configuration, the atmospheric air 13 can flow directly to the blower 12 to be pressurized then the pressurized air stream 22 can flow to the diverting valve 30 and then to an air heater 40.

The blower 12 can have a reversible motor 14. In embodiments, the reversible motor can weigh 63 pounds.

Examples of reversible motors 14 can be any known in the industry that can blow in one direction and suck in another direction. In an embodiment, the reversible motor can be a variable speed motor.

The reversible motor can operate at 1 to 3 horsepower (hp) blowing at a velocity from 0.05 feet per minute to 6850 feet per minute.

The reversible motor can run on batteries, a fuel cell, or an onboard power supply 37.

In embodiments, the reversible motor can connect to a 110 volt current, such as from a wall plug of the structure.

In embodiments, the reversible motor 14 can communicate with an impeller 18 that can be located within an impeller housing 16 adjacent the reversible motor 14.

The impeller 18 in the impeller housing 16 can have from 36 blades to 56 blades.

In embodiments, the impeller can be made from steel or lightweight aluminum.

An impeller inlet 20 can draw atmospheric air 13 to the impeller housing enabling the impeller to pressurize the atmospheric air 13 and create the pressurized air stream 22.

The pressurized air stream 22 is pressurized to a very low pressure, as measured by a manometer from 0.5 inches of water to 75 inches of water.

In embodiments, the diverting valve 30 can flow the pressurized air stream 22 to the air heater 40 through a flow meter 83. If no diverting valve is used, the pressurized air stream 22 can flow directly to the air heater 40 through the flow meter 83.

In embodiments, the diverting valve can be electrically operable and when the diverting valve is electrically operable, the diverting valve connects to the onboard power supply.

The air heater 40 can be an electric powered resistance air heating unit or a heat exchanger for receiving the pressurized air stream 22.

The air heater 40 heats the air to a temperature from ambient to 200 degrees Fahrenheit.

The air heater 40 can form pressurized heated air 50 with the same pressure as the pressurized air stream 22. A constant pressure continues from the blower to an outlet port 56.

A pressure controller 54, which can be located in the moisture removal housing 10, receives the pressurized heated air 50 and maintains the pressurized heated air 50 within a preset temperature range which is controlled by instruments on an instrument panel 70.

Figure 2:
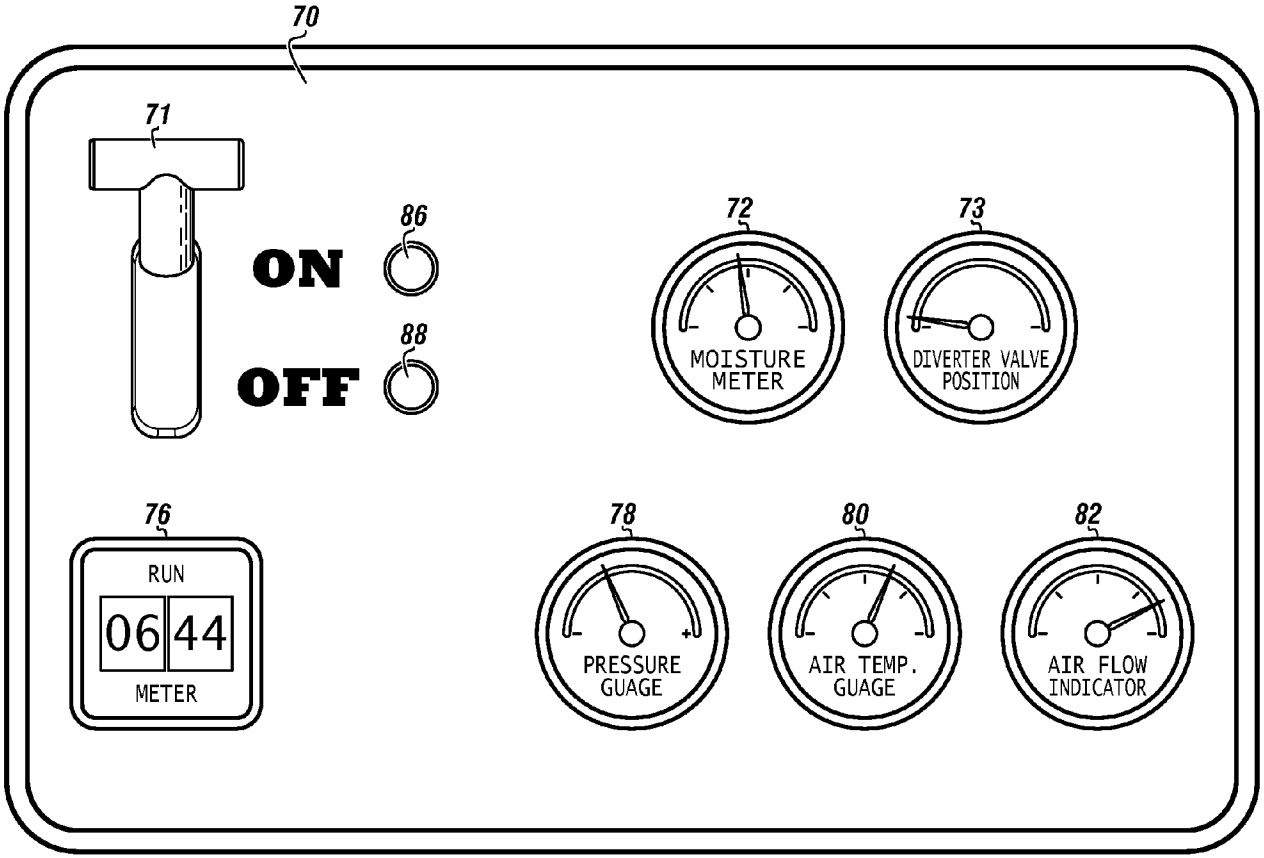
FIG. 2 is a detailed view of an instrument panel usable with the system.

The pressurized heated air 50 can be flowed past a temperate sensor 81, which can be connected to an air temperature gauge 80 shown in FIG. 2, for monitoring temperature of the pressurized heated air 50.

In embodiments, the air pressure controller 54 can flow the pressurize heated air 50 past a pressure sensor 79 connected to a pressure gauge 78, which is shown in FIG. 2, in the instrument panel 70.

The pressure sensor 79 is used for tracking pressure of the pressurized heated air 50 once it leaves the pressure controller 54. The pressure sensor 79 is placed in the pressurized heated air 50 stream.

The pressure controller 54 can regulate blowing pressures and vacuum sucking pressures in sequence. An exemplary pressure controller can be a Dwyer pressure controller.

The pressure controller 54 can flow the pressurized heated air 50 to the outlet port 56 for distribution of the pressurized heated air such as to a docking station 60.

A flexible conduit 58 can connect the outlet port 56 to flow the pressurized heated air 50 away from the moisture removal housing 10 or to flow ambient air from the structure or wall cavity into the moisture removal housing 10.

The docking station 60 can attach to the structure or wall without creating holes in the structure or wall and without using suction cups for flowing the pressurized heated air 50 from the flexible conduit 58 at a targeted location on the structure in the wall cavity.

A quick disconnect 59 can be mounted to the flexible conduit 58 enabling a quick removal or quick attaching to the docking station 60.

In embodiments, the onboard power supply 37 can be connected to the instrument panel 70, the blower 12, the pressure controller 54, and the air heater 40.

FIG. 2 is a detailed view of an instrument panel 70 usable with the reversible portable moisture removal system.

The instrument panel 70 can have an on/off switch 71 for operating the blower, turning on power to the instrument panel and powering the air heater.

The instrument panel 70 can have a moisture meter 72 enabling a user to view changes in moisture content of the pressurized air stream.

The instrument panel 70 can have a diverter valve position gauge 73 for showing if the diverting valve is used, if the diverting valve is in a vacuum sucking position or a blowing pressurized air position.

The instrument panel 70 can have a run meter 76 for tracking time the reversible motor is in operation.

The instrument panel can have a pressure gauge 78, which can display positive and negative pressure of the pressurized heated air as detected by the pressure sensor disposed in the pressurized heated air flow.

The instrument panel 70 can have an air temperature gauge 80, which can display the temperature of the pressurized heated air as sensed by the temperature sensor disposed between the air heater and the pressure controller.

The instrument panel 70 can have an air flow indicator 82, which can be connected to the flow meter which is positioned to monitor flow rates of the pressurized heated air in the moisture removal housing between the blower and the air heater.

In embodiments, the instrument panel can have a green light 86 and a red light 88 indicating the operating status of the reversible motor.

Figure 3:
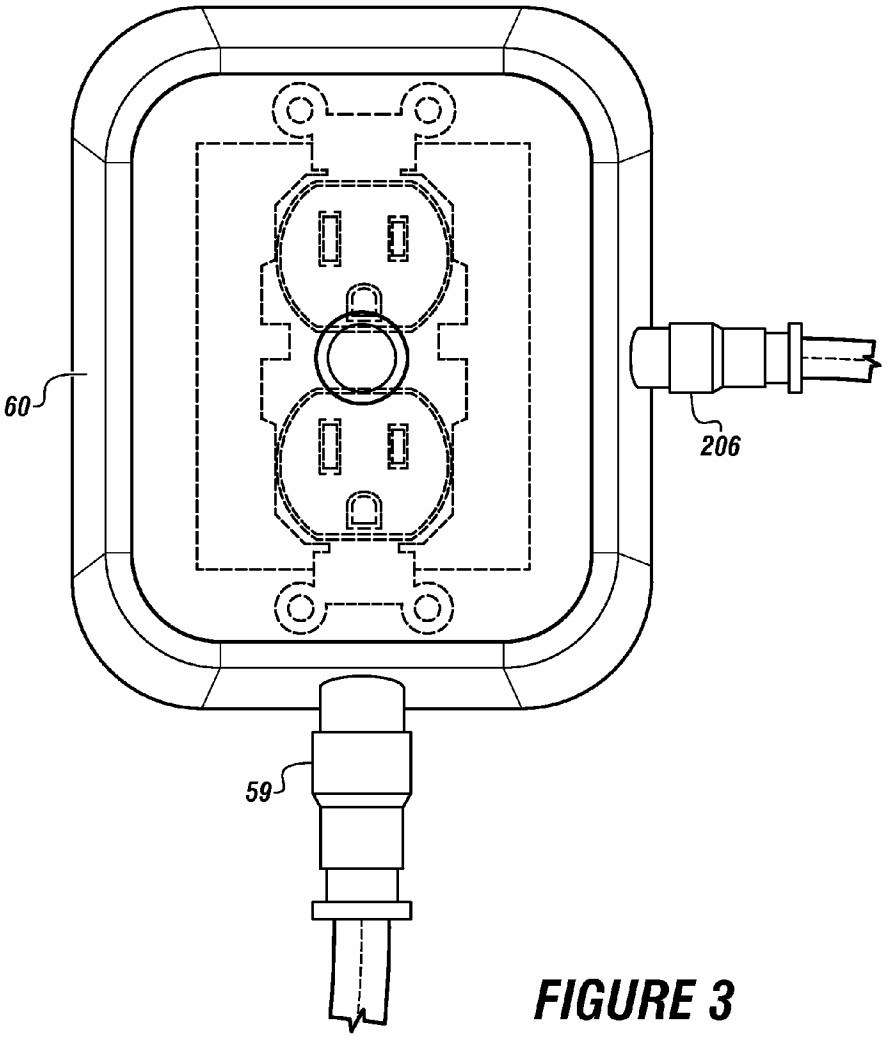
FIG. 3 is a detail of the docking station usable in the system.

FIG. 3 is a detail of the docking station 60 usable in the system.

In this Figure, the docketing station 60 can be mounted in phantom lines to an electrical outlet box typically appearing in the walls of most houses and facilities.

The quick disconnect 59 is shown enabling a quick removal or quick attaching to the docking station 60.

Figure 4:
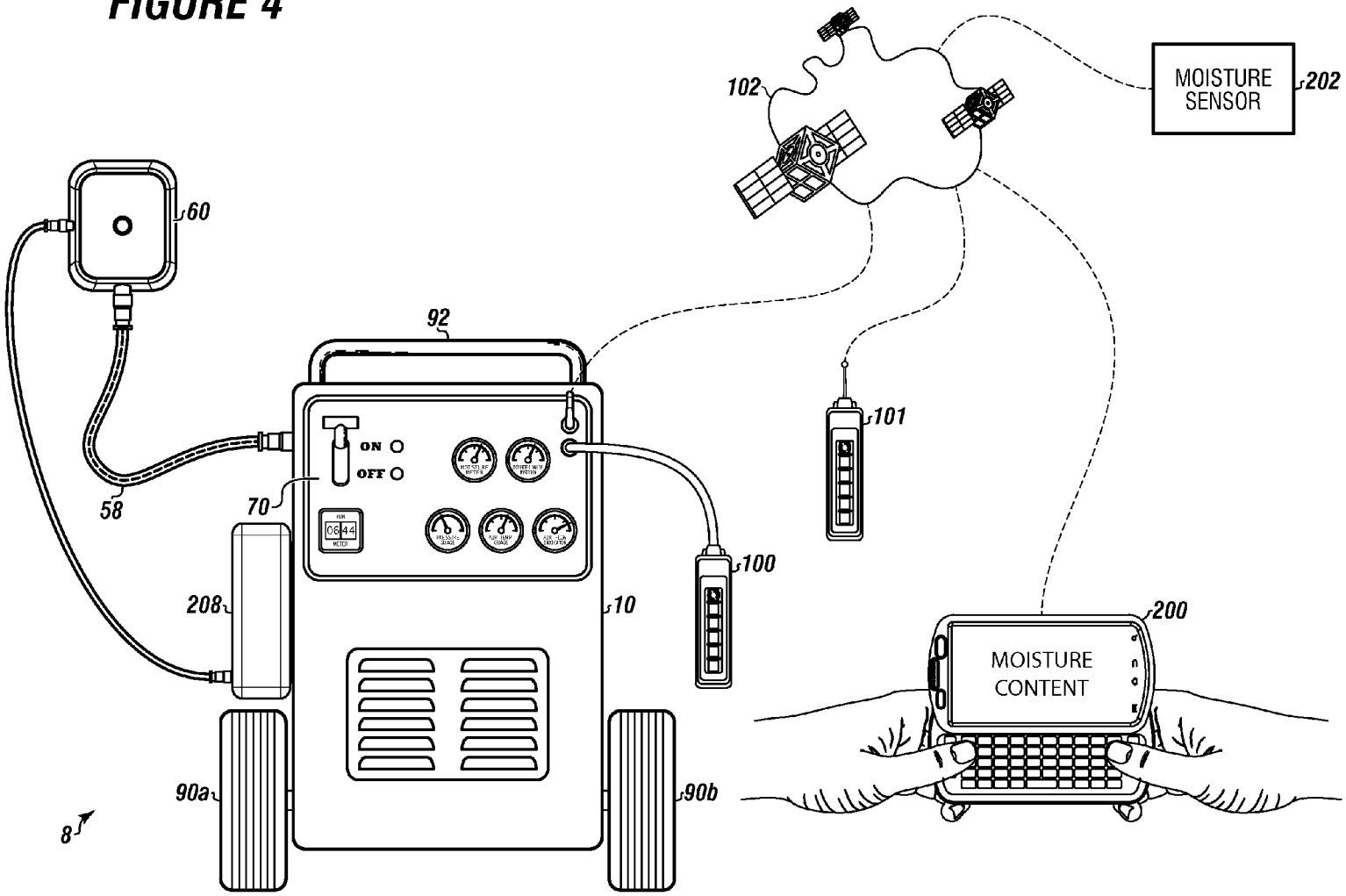
FIG. 4 shows an embodiment of the system connected to a network and at least one client device.

In embodiments, a gas injector 206 can be mounted in the docking station 60 for injecting a gas from a gas reservoir 208, which is shown in FIG. 4, into the wall cavity, structure or facility simultaneously in parallel with the pressurized heated air.

In embodiments, the gas can be ozone, argon, helium, nitrogen, carbon dioxide, or combinations thereof.

FIG. 4 shows an embodiment of the system connected to a network.

The moisture removal housing 10 is shown mounted between a wheel 90*a* and wheel 90*b*. In embodiments, wheels 90*a* and 90*b* can be rotatably secured to the moisture removal housing 10.

In embodiments, a handle 92 can be attached to the moisture removal housing 10. The handle 92 can be "u" shaped for lifting and repositioning the moisture removal housing.

In embodiment, a pendant control station 100 can be used in the system. In embodiments, the pendant control station 100 can be hard wired and can act as a remote control.

The pendant control station 100 can contain a copy of each of the components on the instrument panel 70 and act identical to the instrument panel 70.

The pendant control station 100 (i) provides simultaneous dual monitoring of the reversible portable moisture removal system, and (ii) can control the instrument panel from a remote location.

In embodiments, a wireless remote control device 101 can be in communication with a network 102 for simultaneous monitoring by at least one client device 200.

The wireless remote control device 101 can be used for controlling the instrument panel 70 to additionally (i) provide simultaneous dual monitoring of the reversible portable moisture removal system, and (ii) to control the instrument panel from a remote location without being hard wired.

The reversible portable moisture removal system 8 shows a moisture sensor 202 that can be placed adjacent the structure or wall cavity. In embodiments, the moisture sensor 202 can be in wireless communication with the at least one client device 200, the wireless remote control device 101, or both the at least one client device and the wireless remote control device.

The moisture sensor 202 can communicate wirelessly with the network 102 to display moisture content on at least one client device 200. The at least one client device 200 can display changes in moisture content of the pressurized air stream.

The gas injector can be mounted in the docking station 60 connected to the flexible conduit 58 for injecting a gas from a gas reservoir 208 mounted to the moisture removal housing 10. The gas can be injected into the structure or the wall cavity simultaneously in parallel with the pressurized heated air.

In embodiments, a plurality of reversible portable moisture removal systems can be used. The plurality of reversible portable moisture removal systems can all be connected to the network enabling simultaneous viewing of multiple systems by multiple client devices connected to the network.

Figure 5:
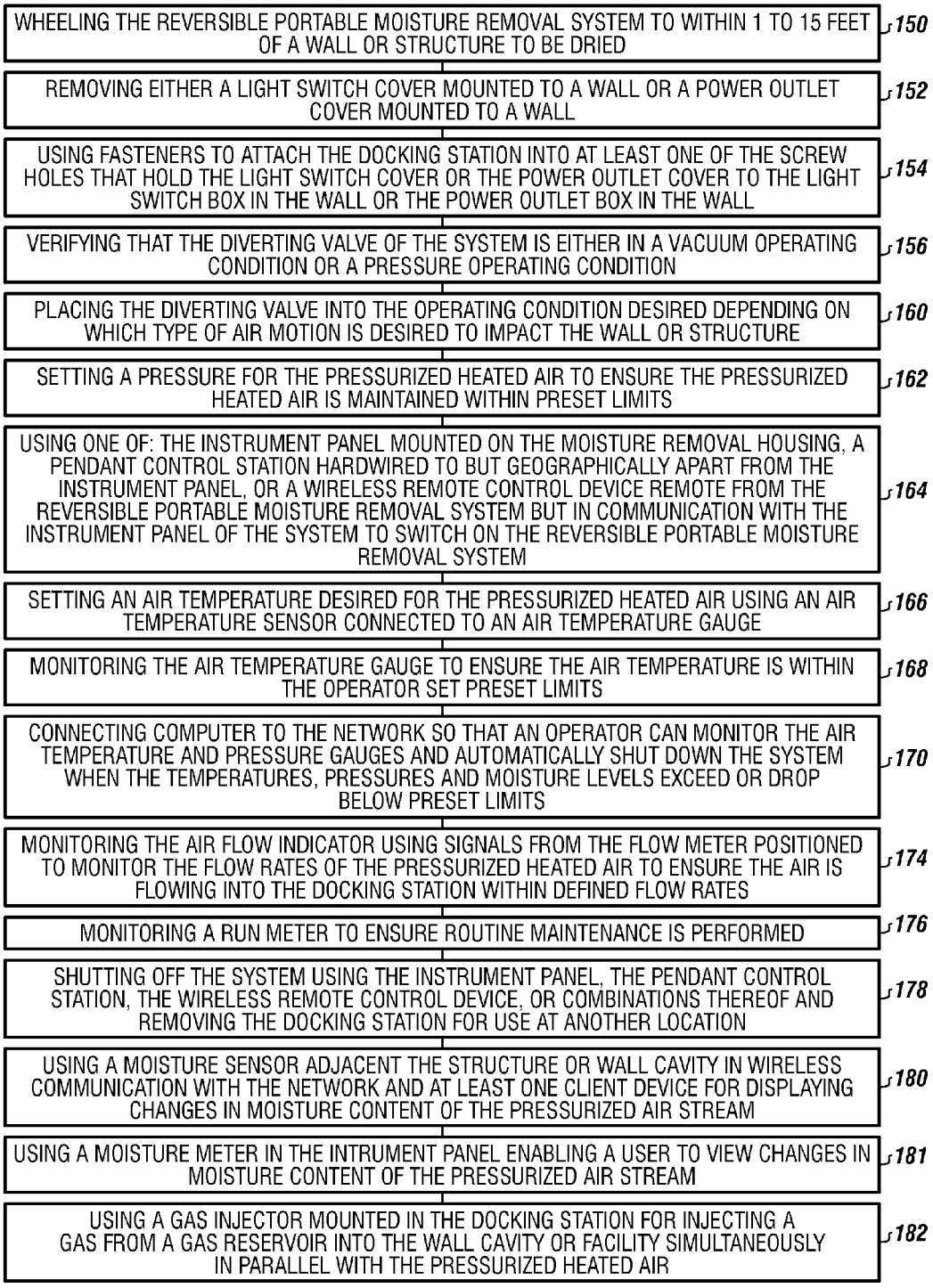
FIG. 5 is a diagram of an embodiment of steps of the method.

FIG. 5 is a diagram of an embodiment of steps of the method.

In embodiments, the method steps can be performed by an operator.

The method can include wheeling the reversible portable moisture removal system to within 1 foot to 15 feet of a wall or structure to be dried, as shown in step 150.

The method can include removing either a light switch cover mounted to a wall or a power outlet cover mounted to a wall, as shown in step 152.

The method can include using fasteners to attach the docking station into at least one of the screw holes that hold the light switch cover or the power outlet cover to the light switch box in the wall or the power outlet box in the wall, as shown in step 154.

When the diverting valve of the system is used, the method can include verifying that the diverting valve of the system is either in a vacuum operating condition or a pressure operating condition, as shown in step 156.

The method can include placing the diverting valve into the operating condition desired depending on which type of air motion is desired to impact the wall or structure, as shown in step 160.

The method can include setting a pressure for the pressurized heated air to ensure the pressurized heated air is maintained within preset limits, as shown in step 162.

The method can include using one of: the instrument panel mounted on the moisture removal housing, a pendant control station hardwired to but geographically apart from the instrument panel, or a wireless remote control device remote from the reversible portable moisture removal system but in communication with the instrument panel of the system to switch on the reversible portable moisture removal system, as shown in step 164.

The method can include setting an air temperature desired for the pressurized heated air using an air temperature sensor connected to an air temperature gauge, as shown in step 166.

In embodiments, the air temperature gauge can be mounted on the instrument panel.

Once the air temperature gauge is set, the air temperature gauge can be monitored to ensure the air temperature is within preset limits.

In embodiments, the gauges can contain setpoints which enable the entire moisture removal process to be automated once the system is turned on.

In embodiments, the method can be completely automated where the wireless remote controls actuate the system.

In embodiments when no setpoint is used, the method can include monitoring the air temperature gauge to ensure the air temperature is within the operator set preset limits, as shown in step 168.

In embodiments, the method can include connecting a computer to the network so that an operator can monitor the air temperature and pressure gauges and can automatically shut down the system when the temperatures, pressures and moisture levels exceed or drop below preset limits, as shown in step 170.

The following steps can be performed by an operator or another computer.

The method can include monitoring the air flow indicator using signals from the flow meter positioned to monitor the flow rates of the pressurized heated air to ensure the air is flowing into the docking station within defined flow rates, as shown in step 174.

The method can include monitoring a run meter to ensure routine maintenance is performed, as shown in step 176.

The method can include shutting off the system using the instrument panel, the pendant control station, the wireless remote control device, or combinations thereof and removing the docking station for use at another location, as shown in step 178.

The method can include using a moisture sensor adjacent the structure or wall cavity in wireless communication with the network and at least one client device for displaying changes in moisture content of the pressurized air stream, as shown in step 180.

The method can include using a moisture meter in the instrument panel enabling a user to view changes in moisture content of the pressurized air stream, as shown in step 181.

The method can include using a gas injector mounted in the docking station for injecting a gas from a gas reservoir into the wall cavity or facility simultaneously in parallel with the pressurized heated air, as shown in step 182.

In embodiments, the gas can be ozone, argon, helium, nitrogen, carbon dioxide, or combinations thereof.

In embodiments, the method if a diverting valve is used, the diverting valve can be electrically operable and when the diverting valve is electrically operable, the diverting valve can connect to the onboard power supply and can be controlled by the instrument panel and at least one remote control.

In embodiments, a green light and red light can be used on the instrument panel to indicate operating status of the motor.

In embodiments, the method can use a variable speed motor as the reversible motor.

In embodiments, the method can install and use of an onboard power supply in the moisture control housing and connect the onboard power supply to the instrument panel, the blower, the pressure controller, the air heater and combinations thereof.

In embodiments, the method can use a filter, a silencer or both the filter and the silencer as the intake means.

In embodiments, a least one wheel, such as a first wheel and a second wheel, can be rotatably mounted to the moisture removal housing of the system enabling the system to be moved by one person.

In embodiments, the method can include installing a handle on the moisture removal housing to facilitate lifting and repositioning of the moisture removal housing.

In embodiments, the method can include using a quick disconnect on the flexible conduit emanating from the moisture removal housing of the system enabling a quick removal or quick attaching to the docking station from the flexible conduit.

In embodiments, the method can use the hardwired a pendant control station connected to the instrument panel to (i) provide simultaneous dual monitoring of the system and (ii) to control the instrument panel of the system from a remote location.

In embodiments, the method can use a wireless remote control device wirelessly connected to the instrument panel, to control an instrument panel of the system to (i) provide simultaneous dual monitoring of the system, and (ii) to control the instrument panel from a remote location.

The method can include connecting at least one: the wireless remote control device and a client device also in communication with the network, such as cell phones, laptops or other computers, for simultaneous monitoring of the moisture control system by at least one client device.

In embodiments, the method can include installing a wheeled dolly to a moisture control housing of the system for ease of transport by a single person.

While these embodiments have been described with emphasis on the embodiments, it should be understood that within the scope of the appended claims, the embodiments might be practiced other than as specifically described herein.

What is claimed is:

1. A method for drying a wall cavity or structure without the need to tear to make holes, tear apart the structure, or use suction cups, comprising:

a. wheeling a reversible portable moisture removal system within 1 foot to 15 feet of the wall cavity or structure to be dried;

b. removing either (i) a light switch cover mounted to a wall or (ii) a power outlet cover mounted to the wall cavity or structure;

c. installing a docking station of the reversible portable moisture removal system using fasteners and attaching the docking station into at least one of the screw holes that hold the light switch cover or the power outlet cover to a light switch box in the wall or a power outlet box in the wall cavity or structure;

d. setting a pressure for a pressurized heated air to ensure the pressurized heated air is maintained within preset limits;

e. controlling the reversible portable moisture removal system with either: (i) an instrument panel mounted on a moisture removal housing, (ii) a pendant control station hardwired to but geographically apart from the instrument panel or (iii) a wireless remote control device remote from the reversible portable moisture removal system but in communication with the instrument panel of the reversible portable moisture removal system to switch on the reversible portable moisture removal system;

f. setting an air temperature desired for the pressurized heated air using an air temperature sensor connected to an air temperature gauge;

g. using a computer connected to a network or an operator to monitor the air temperature sensor and a pressure gauge and automatically shut down the pressurized heated air flow when the temperatures and pressures exceed or drop below preset limits;

h. monitoring the air flow indicator using signals from a flow meter positioned to monitor the flow rates of the pressurized heated air to ensure the air is flowing into the docking station within defined flow rates, and when the wall cavity or structure achieves a moisture rating within defined limits; and i. shutting off the reversible portable moisture removal system using at least one of:

the instrument panel, the pendant control station, and the wireless remote control device and removing the docking station for use at another location.

2. The method of claim 1, comprising installing a green light and a red light on the instrument panel to indicate operating status of an reversible motor.

3. The method of claim 2, comprising using a variable speed motor as the reversible motor.

4. The method of claim 1, comprising installing an onboard power supply into the moisture removal housing of the reversible portable moisture removal system and connecting the onboard power supply to the instrument panel, a blower, a pressure controller, and an air heater.

5. The method of claim 1, comprising using an intake means for receiving atmospheric air, wherein the intake means is disposed in the moisture removal housing.

6. The method of claim 5, wherein the intake means is a filter, a silencer or both.

7. The method of claim 1, comprising installing at least one wheel rotatably mounted to the moisture removal housing of the reversible portable moisture removal system.

8. The method of claim 1, comprising installing a handle on the moisture removal housing for lifting and repositioning the moisture removal housing.

9. The method of claim 1, comprising installing a quick disconnect on a flexible conduit emanating from the moisture removal housing enabling a quick removal or a quick attaching to the docking station from the flexible conduit.

10. The method of claim 1, comprising using the pendant control station hardwired to the instrument panel to (i) provide simultaneous dual monitoring of the reversible portable moisture removal system and (ii) to control the instrument panel from a remote location.

11. The method of claim 1, comprising using the wireless remote control device in communication with the instrument panel, and controlling the instrument panel to (i) provide simultaneous dual monitoring of the reversible portable moisture removal system and (ii) to control the instrument panel from a remote location.

12. The method of claim 10, comprising using at least one of: the wireless remote control device, the at least one client device, or combinations thereof connected to a network for simultaneous monitoring the reversible portable moisture removal system.

13. The method of claim 12, comprising connecting a plurality of reversible portable moisture removal systems to the network enabling simultaneous viewing of the plurality of the plurality of reversible portable moisture removal systems by the at least one client device connected to the network.

14. The method of claim 2, comprising using a run meter mounted to the instrument panel to track time that the reversible motor is in operation.

15. The method of claim 12, comprising using a moisture sensor adjacent the wall cavity or structure in wireless communication with at least one of:

a. the network with the at least one client device for displaying changes in moisture content of a pressurized air stream; and b. a moisture meter in the instrument panel enabling a user to view changes in moisture content of the pressurized air stream.

16. The method of claim 1, comprising using a gas injector mounted in the docking station for injecting a gas from a gas reservoir into the wall cavity or structure simultaneously in parallel with the pressurized heated air.

17. The method of claim 16, wherein the gas is ozone, argon, helium, nitrogen, carbon dioxide, or combinations thereof.

* * * * *